US006568565B1

(12) United States Patent
Schroeder et al.

(10) Patent No.: US 6,568,565 B1
(45) Date of Patent: May 27, 2003

(54) METHOD AND APPARATUS FOR DISPENSING PRODUCT

(75) Inventors: Alfred A. Schroeder, San Antonio, TX (US); Michael T. Romanyszyn, San Antonio, TX (US); John Vira, Lockhart, TX (US); Merrill R. Good, San Antonio, TX (US); Thomas J. Chadwell, San Antonio, TX (US); David C. Sudolcan, Atascosa, TX (US); Paul S. Sudolcan, Seguin, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/826,304

(22) Filed: Apr. 4, 2001

(51) Int. Cl.[7] ..... B67D 5/56

(52) U.S. Cl. ..... 222/105; 222/129.3; 222/327; 222/95

(58) Field of Search ..... 222/95, 105, 129.1, 222/129.2, 129.3, 333, 327, 383.1

(56) References Cited

U.S. PATENT DOCUMENTS 5,058,780 A * 10/1991 Plester et al. ..... 222/333
5,494,193 A * 2/1996 Kirschner et al. ..... 222/129.1
5,797,519 A * 8/1998 Schroeder et al. ..... 222/129.1
5,803,317 A * 9/1998 Wheeler ..... 222/105
5,842,603 A * 12/1998 Schroeder et al. ..... 222/129.1
5,992,685 A * 11/1999 Credle, Jr. ..... 222/129.1

* cited by examiner

*Primary Examiner*—Kenneth Bomberg
(74) *Attorney, Agent, or Firm*—Christopher L. Makay

(57) ABSTRACT

A method and apparatus for dispensing a product includes a support housing, a disposable or non-disposable pump, a disposable product package connectable to the pump, a pump driver connectable to the pump, and a dispensing station on the support housing. The dispensing station supports the pump driver and is adapted to receive the pump and disposable product package. The disposable product package and the pump driver connect to the pump. The pump driver operates the pump to draw product from the disposable product package. When the disposable product package is empty, the disposable product package and the pump if disposable are removed from the dispensing station and disposed.

14 Claims, 6 Drawing Sheets

METHOD AND APPARATUS FOR DISPENSING PRODUCT

BACKGROUND OF THE INVENTION

1. Field of the Invention

The present invention relates to a method and apparatus for dispensing and, more particularly, but not by way of limitation, to a method and apparatus for dispensing food products and food product concentrates, such as pizza sauce, soft ice cream, mustard, ketchup, mayonnaise, soup, salad dressing, juice concentrates, and the like.

2. Description of the Related Art

The viscosity of food products varies widely and ranges from relatively hard (e.g., soft ice creams) to semi-liquids (e.g., pizza sauce, ketchup, and mustard) to liquids (e.g., soups). Problems associated with viscous products or soups that contain solids arise because an employee or a customer typically manually dispenses such products. These problems relate to consistency, quality, cost, cleanliness, and the like.

For example, ketchup and mustard usually have separate dispensers that each consist of a container having a pump. Although employees do not directly dispense ketchup and mustard, an employee must fill the dispensers when they are empty. This results in direct employee contact with both the dispensers and the ketchup and mustard. Furthermore, if the dispensers are not routinely cleaned or are cleaned improperly, an unsanitary condition situation arises.

As another example, some food products, such as pizza sauce or soup, come in concentrate packages. An employee opens the concentrate package and empties the package into a large, typically open container. The employee then adds water and mixes the concentrate and water to form the final product. Then, as needed for final preparation or consumption, an employee or customer ladles the final product from the large open container. Thus, the final product can remain uncovered for long periods and employees or customers often contact the final product, both of which are unsanitary.

Manual dispensing of food products occurs because heretofore the cost for dispensers suitable to dispense such products has been prohibitive. Accordingly, a product dispenser and a method of dispensing food product are needed that permit self-contained dispensing of food products and food product concentrates, such as pizza sauce, soft ice cream, mustard, ketchup, mayonnaise, soup, salad dressing, and the like.

SUMMARY OF THE INVENTION

In accordance with the present invention, a product dispenser includes a support housing, a disposable or non-disposable pump, a disposable or non-disposable product package connectable to the pump, a pump driver connectable to the pump, and a dispensing station.

The dispensing station may also include a platform secured to a support housing, a base residing on the platform over the pump driver and defining a pump slot that receives the pump therein, and a container supported by the base that receives the disposable product package therein. The disposable product package and the pump driver connect to the pump. The pump driver operates the pump to draw product from the disposable product package. When the disposable pro duct package is empty, the disposable product package and the pump if disposable are removed from the dispensing station and disposed.

The disposable product package may include a bag and a fitting secured to the bag wherein the fitting snap fits into an inlet of the pump adapted to receive the fitting therein. A mixing chamber is connectable to an outlet of the pump, whereby the mixing chamber is disposable with the pump if disposable when the disposable product package is empty. The mixing chamber includes a diluent inlet that introduces diluent into the mixing chamber for combination with product delivered into the mixing chamber by the disposable pump. A product delivery device may be coupled to an outlet of the mixing chamber.

The pump driver may include a driving fork connectable to the pump and a driver unit coupled with the driving fork, whereby the driver unit operates the driving fork to facilitate the drawing of product by the pump from the disposable product package. The pump driver may further include a frame mountable to the dispensing station and adapted to link the driving fork with the driver unit.

The driver unit may include a motor coupled with the driving fork via a drive shaft engageable with the driving fork and a gearbox coupled with the drive shaft and with the motor for transferring the driving force of the motor to the drive shaft. The driver unit may further include a clutch unit mountable onto the drive shaft for interfacing the drive shaft with driving fork. The driving fork includes an interface that engages a piston of the pump to couple the driving fork with the pump and a drive slot that engages the drive shaft of the driver unit to couple the driving fork with the driver unit.

A method of dispensing product includes inserting a disposable pump into a dispensing station. A disposable product package is inserted into a dispensing station. The disposable product package is connected to the disposable pump. A pump driver is connected to the disposable pump. The disposable pump is operated via the pump driver to draw product from the disposable product package. The disposable product package and the disposable pump are removed from the dispensing station and disposed when the disposable product package is empty.

Another method of dispensing a product measures diluent flow and controls a disposable pump, based on the measured flow, to pump the product. The diluent and the product are mixed and dispensed. The method further includes shipping the product and the pump, coupling the product to the pump at a location where dispensing occurs, and installing the coupled product and pump in a dispenser. Conversely, the product and pump may be coupled during installation in the dispenser. Alternatively, the method further includes coupling the product and the pump, shipping the coupled product and pump to a location where dispensing occurs, and installing the coupled product and pump in a dispenser.

Still another method of dispensing a product includes shipping a disposable pump, shipping the product, coupling the product to the pump at a location where dispensing occurs, pumping the product in the pump, and dispensing the product. The method further includes installing the coupled product and pump in a dispenser or, conversely, coupling the product and pump during installation in the dispenser. Alternatively, the product and pump may be shipped together. The method still further includes mixing the product with a diluent and dispensing the mixture of the product and the diluent.

A further method of dispensing product includes coupling the product to a disposable pump, shipping the coupled product and pump to a location where dispensing occurs, installing the coupled product and pump in a dispenser, pumping the product, and dispensing the product.

It is therefore an object of the present invention to provide a product dispenser that receives a disposable product package and a disposable pump therein.

It is another object of the present invention to provide a product dispenser that includes a pump therein and receives a disposable product package therein.

It is still another object of the present invention to provide a product dispenser that combines a product concentrate with a diluent during dispensing to form and end product thereof.

It is a further object of the present invention to provide a product dispenser suitable for connection with an end product delivery device.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

BRIEF DESCRIPTION OF THE DRAWINGS

FIG. 4 illustrates a driving fork of the pump driver.

FIG. 6 illustrates a clutch unit of the pump driver.

FIG. 7 illustrates methods of dispensing product.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

Figure 1:
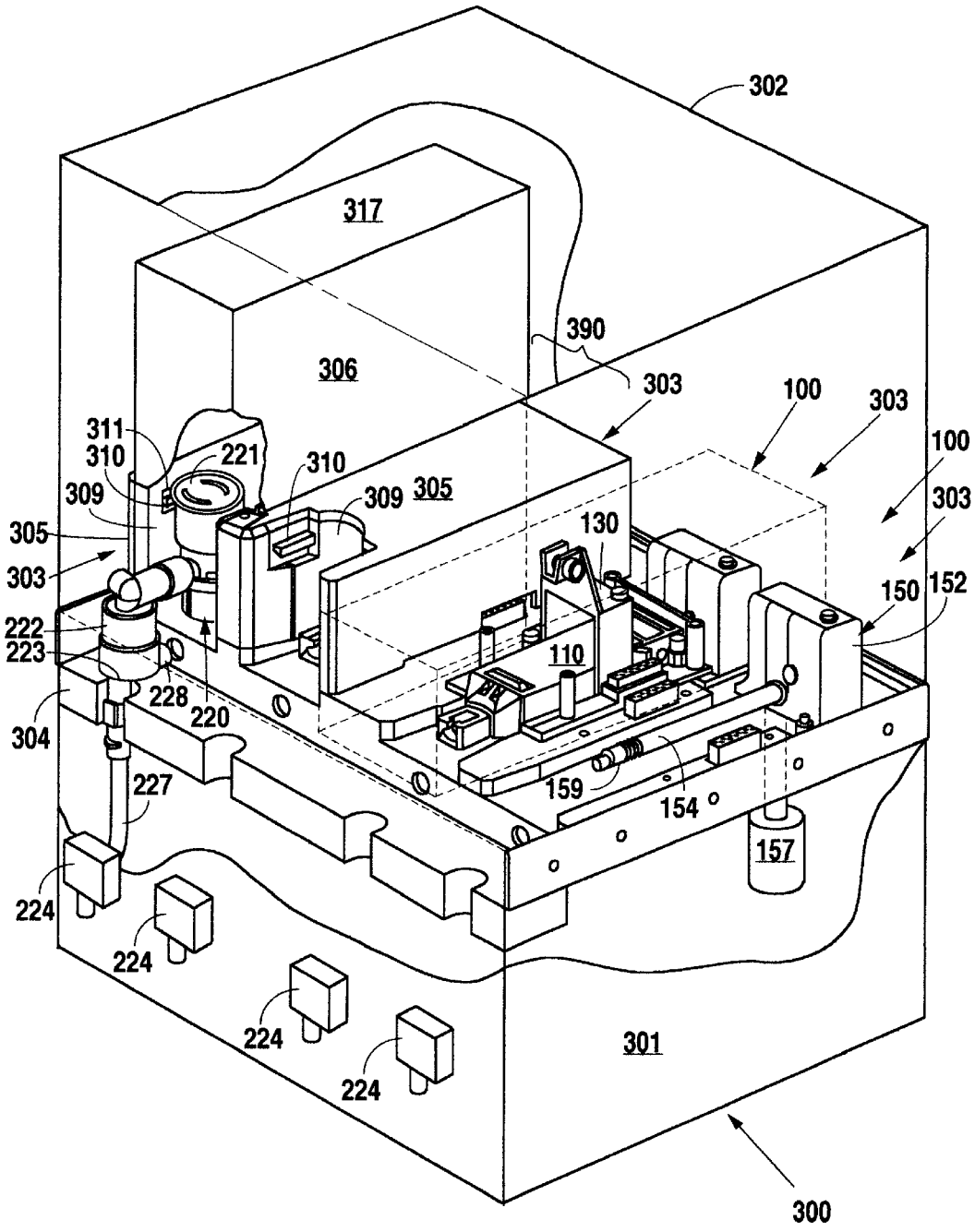
FIG. 1 is a perspective view including cut-away portions illustrating a product dispenser according to the preferred embodiment.
Figure 2:
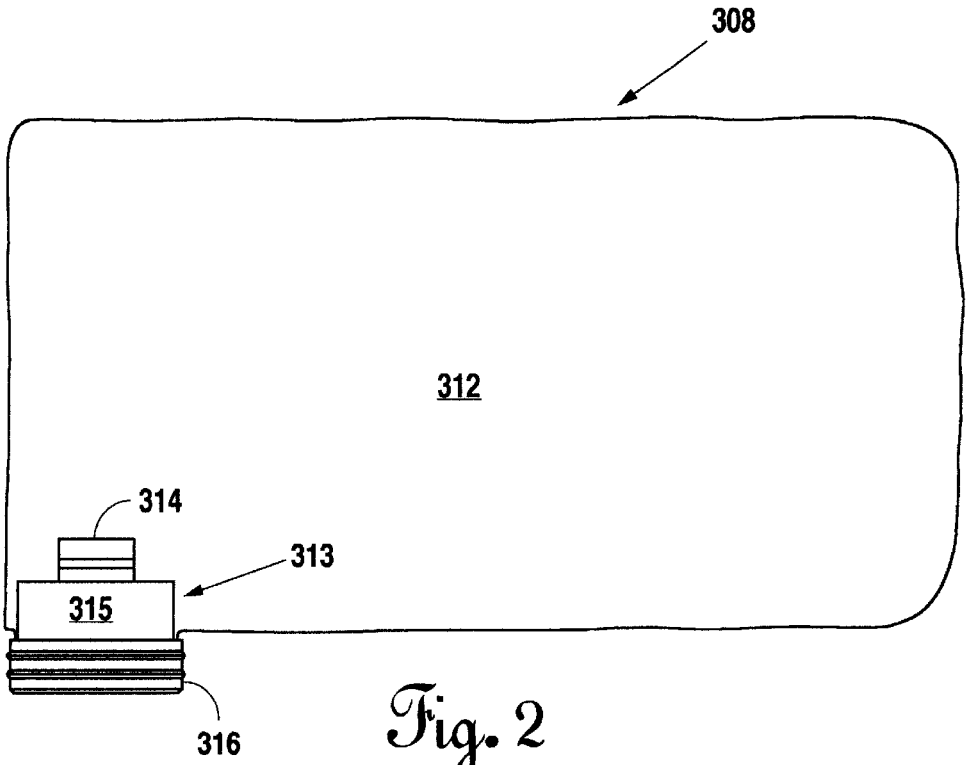
FIG. 2 is a side view illustrating a product package according to the preferred embodiment.

As illustrated in FIG. 1, a product dispenser 300 includes a support housing 301 and a cover 302 mounted removably atop the support housing 301. The support housing 301 supports and houses the components of the product dispenser 300. Similarly, the cover 302 surrounds and thus protects the components of the product dispenser 300.

The support housing 301 includes at least one dispensing station 303 secured to the support housing 301 at an upper portion thereof and a pump driver 100 supported by the dispensing station 303. The dispensing station 303 includes a platform 304, a base 305 residing on the platform 303 over the pump driver 100, and a container 306 supported by the base 305. This preferred embodiment discloses the product dispenser 300 including four dispensing stations 303 and four pump drivers 100 to illustrate the dispensing of multiple products, such as ketchup, mustard, mayonnaise, salad dressing, and the like. Nevertheless, only one dispensing station 303 and one pump driver 100 may be used.

As illustrated in FIGS. 1–6, the pump driver 100 drives a pump 220 to facilitate the dispensing of product from a product package 308. The pump 220 includes a piston 225 as in FIG. 5 engageable with the pump driver 100 to effect the drawing of product from the product package 308. The dispensing station 303 provides a housing that holds the pump 220 and further permits the attachment of the pump 220 to the pump driver 100 via the piston 225. Particularly, the base 305 includes a pump slot 309 for receiving the pump 220 therein. The pump slot 309 includes tabs 310 that engage flanges 311 on the pump 220 to aid in holding the pump therein.

The pump 220 includes an inlet 221 suitable for connection with the product package 308 and an outlet 222 suitable for connection with a mixing chamber 223. The mixing chamber 223 in turn connects to a dispensing outlet 224 via a tube 227. Although this preferred embodiment discloses a dispensing outlet 224, the mixing chamber 223 may connect to any other suitable end product delivery device, such as a pizza sauce spreader and the like. The mixing chamber 223 includes a diluent inlet 228 connected to a diluent source that delivers a diluent (e.g., water) into the mixing chamber 223. In this preferred embodiment, the mixing chamber 223 includes a mixing device suitable to facilitate the combining of the product and diluent. Consequently, the pump 220 delivers product, typically in concentrate form, into the mixing chamber 223, and the diluent source delivers diluent into the mixing chamber 223 via the diluent inlet 228, resulting in the product and diluent combining in the mixing chamber to form an end product dispensed from the dispensing outlet 224. Although a mixing chamber 223 has been disclosed, those of ordinary skill in the art will recognize that the pump 220 may directly connect to the dispensing outlet 224 when the product does not require a diluent or when mixing before dispensing is not required.

To ensure desired mixed concentrations of product and diluent, a suitable flow control device may be provided between the diluent source and the diluent inlet 228, and the pump driver 100 could be controlled to operate the pump 220 at a preset rate. Alternatively, a suitable metering device could be provided between the diluent source and the diluent inlet 228. The metering device provides metered amounts of diluent and further measures diluent flow to produce a signal thereof, which is used to control the pump driver 100 and drive the pump 220 such that the pump 220 delivers a desired amount of product for combination with diluent. An example of a suitable metering device is disclosed in U.S. Pat. No. 6,435,375.

The pump 220 in this preferred embodiment is a reciprocating piston type pump commonly associated with product dispensing. Although this preferred embodiment discloses a reciprocating piston type pump, any suitable alternative, such as progressive cavity pump, may be used.

The product package 308 includes a bag 312 coupled with a fitting 313 whereby the fitting inserts into the inlet 221 of the pump 220. The fitting 313 includes an inlet 314, a base 315, and an outlet 316. The base 315 engages the bag 312 and is permanently secured thereto using any suitable means such as a heat or sonic weld or suitable adhesive. The outlet 316 snap fits into the inlet 221 of the pump 220 to facilitate the delivery of product thereto. In this preferred embodiment, the bag 312 is constructed from flexible plastic material; however, other materials, such as, without limitation, plastic (e.g. PET) may also be used. Also, the pump may be adapted to receive product from any type of source, and the snap fit described herein is exemplary only.

The dispensing station 303 provides a housing that holds the product package 308 and further permits the attachment of the product package 308 to the pump 220. Particularly, the container 306 includes an opening 317 that receives the product package 308 therethrough to permit placement of the bag 312 within the container 306 such that the fitting 313 resides over the pump slot 309 of the base 305. Consequently, with the insertion of a pump 220 into the pump slot 309, the outlet 316 snap fits into the inlet 221 of the pump 220 to facilitate the delivery of product thereto. The fitting 313 is secured to the bag 312 in a position permitting easy location of the fitting 313 over the pump slot 309 upon placement of the product package 308 into the container 306. Although this preferred embodiment discloses a separate pump 220 and product package 308, the dispensing station 303 may be adapted to receive an integral pump 220 and a product package 308 shipped together as a single unit.

The pump driver 100, particularly illustrated in FIGS. 1 and 3–6, includes a driving fork 110 connectedly engaged with the pump 220 for providing a requisite motion to drive the pump 220. Moreover, the pump driver 100 includes a driver unit 150 cooperatively linked with the driving fork 110, whereby the driver unit 150 controls the rate by which the driving fork 110 moves and, thus, the rate by which product is pumped from the product package 308. The driver unit 150 includes a standard motor 157 and a drive shaft 154 coupled to the motor 157 via a gearbox 152. The gearbox 152 transfers the driving force of the motor 157 to the drive shaft 154 as well as permits variable control in the direction and speed of the drive shaft 154. The gearbox 152 mounts onto the platform 304 of the dispensing station 303 to locate the drive shaft under the base 305, while the motor 157 mounts underneath the platform 304. Although this preferred embodiment discloses the driver unit 150 as including a gearbox 152 and a drive shaft 154, the motor 157 could connect directly to the driving fork 110.

In this preferred embodiment, the driver unit 150 includes a clutch unit 159 that facilitates attachment of the drive shaft 154 to the driving fork 110. Nevertheless, the clutch unit 159 is not necessary as the requisite attachment mechanism could be incorporated directly onto the drive shaft 154.

The preferred pump driver 100 further includes a frame 130 mountable to platform 304 of the dispensing station 303 for linking the driving fork 110 and the driver unit 150 in cooperative engagement. The frame 130 includes alignment bearings 132 engagedly coupled with the drive shaft 154 to ensure desirable operation of the driver unit 150. The frame 130 further includes a locking subassembly 135 for securing the driving fork 110 with the frame 130.

Figure 4A:
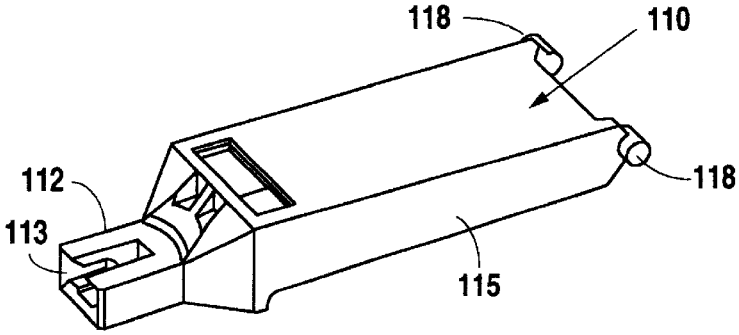
FIG. 4*a* is a perspective view illustrating the driving fork.
Figure 4B:
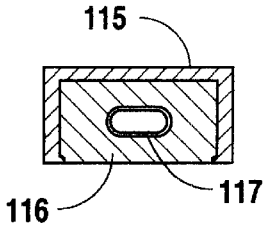
FIGS. 4*b* and 4*c* are cross-sectional views illustrating the driving fork.
Figure 4C:
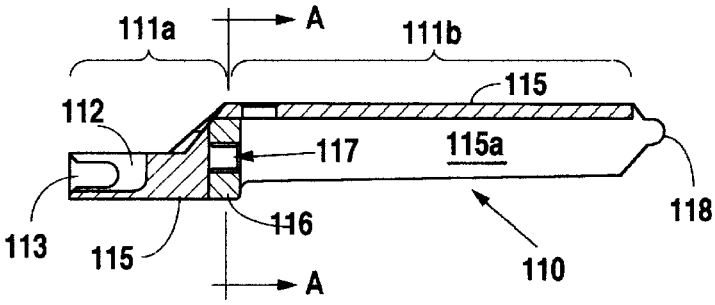
Figure 3:
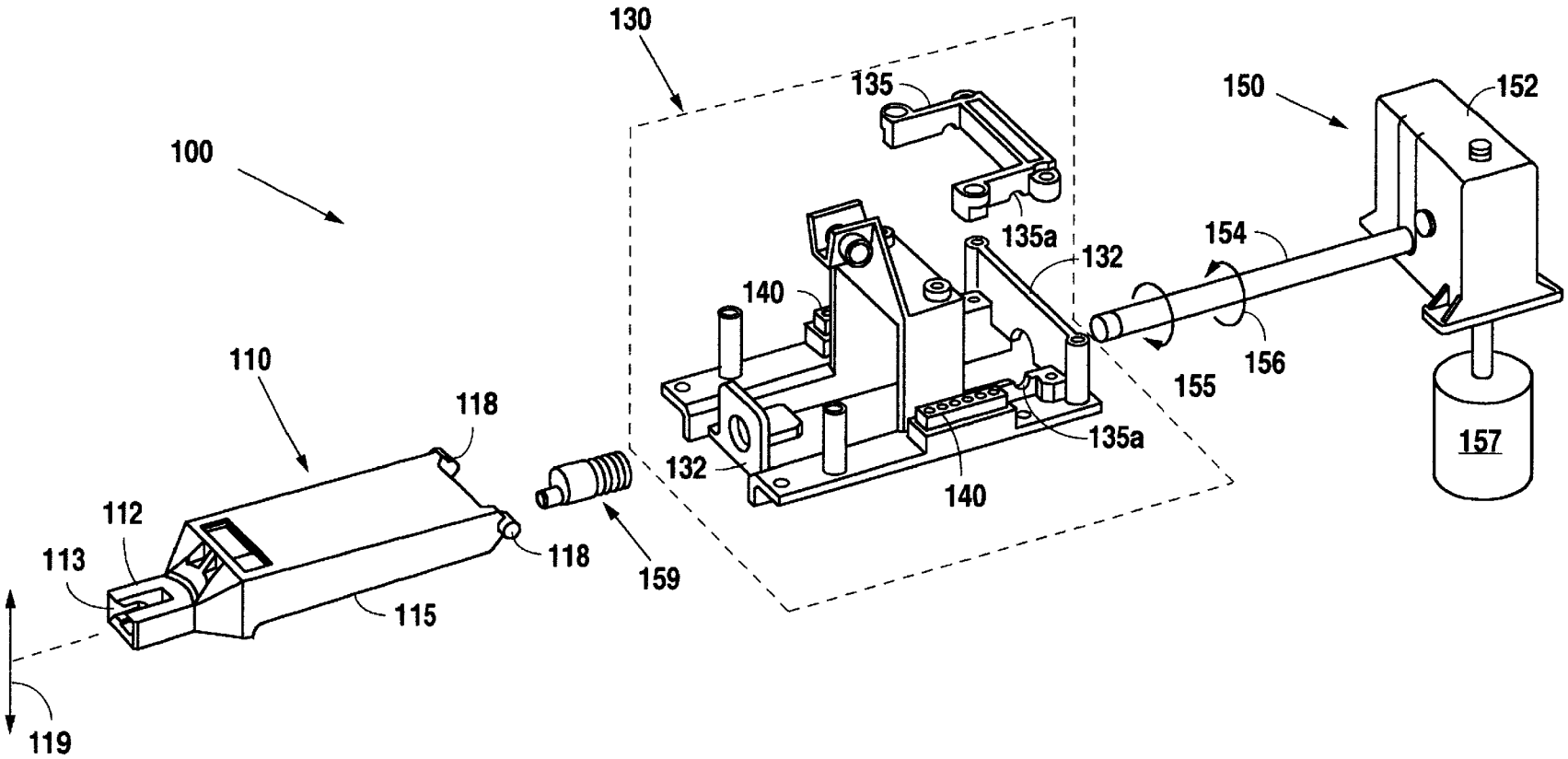
FIG. 3 is an exploded perspective view illustrating a pump driver according to the preferred embodiment.

The driving fork 110 as illustrated in FIG. 4*c* includes a body 115, preferably constructed as a single piece. Moreover, the driving fork 110 is preferably divided into two portions, a head portion 111*a* for engagement with the pump 220 and a lever portion 111*b* extending outwardly from the head portion 111*a*. The lever portion 111*b* includes a lever arm 115*a* preferably spanning the length of the lever portion 111*b* for imparting motion to the head portion 111*a*. The lever portion 111*b* may include fork coupling elements 118 opposite the head portion 111*a* and extending outwardly from the lever arm 1115*a*. As illustrated in FIG. 3, the fork coupling elements 118 are hingedly engaged with the frame 135 via corresponding locking notches 135*a* provided by the locking subassembly 135.

Figure 5:
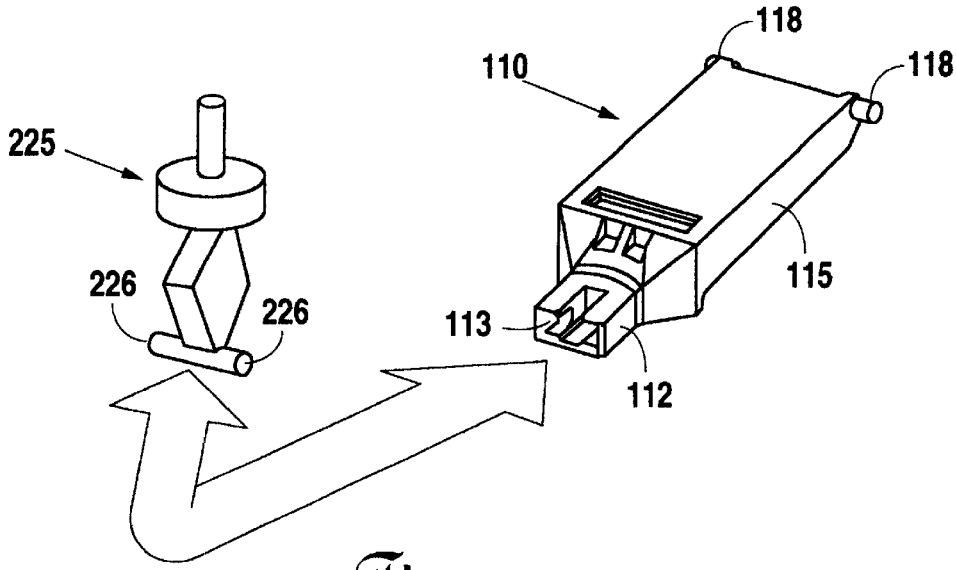
FIG. 5 is an exploded perspective view illustrating the driving fork connectedly engaged with a pump plunger of a pump.

The head portion 111*a* includes an interface 112 for contactedly engaging the piston 225 to thus drive the pump 220. Specifically, in this preferred embodiment, the interface 112 defines a receiving slot 113 for engagement with corresponding piston ears 226 extending outwardly from the piston 225. As illustrated in FIG. 5, the piston ears 226 slideably engage the receiving slot 113 so that the piston 225 is coupled with the pump interface 112.

The head portion 111*a* includes a drive slot 117 contactedly engaged by the clutch unit 159. In operation, the clutch unit 159 traverses the drive slot 117, thereby furnishing a desired motion to the driving fork 110 and, ultimately, to drive the pump 220. The drive slot 117 in this preferred embodiment is substantially elliptical in shape to facilitate an up and down motion of the driving fork 110 and the piston 225, as indicated in FIG. 3 by directional arrow 119. Nevertheless, other suitable shapes for the drive slot 117 may be used that are suitable to supply a correspondingly desired motion thereof.

Furthermore, as illustrated in FIG. 4*b*, a releasable member 116 forms the drive slot 117 and secures to the body 115 to the body 115 using any suitable means. Accordingly, the releasable member 116 facilitates ease of exchange with other releasable members having clutch unit slots of different configurations that supply correspondingly different motions to the driving fork 110 and the piston pump driver 220. It should be added that other embodiments contemplate the drive slot 117 as defined by the body 115.

As indicated by directional arrow 155 in FIG. 3, the driver unit 150 of the pump driver 100 preferably supplies a rotary motion so that the driving fork 110 may assume an up and down motion to drive the pump 220. However other suitable motive directions of the driver unit 150 may be used for driving the pump 220.

The clutch unit 159 interfaces the drive shaft 154 and the driving fork 110. In particular, FIG. 1 illustrates the clutch unit 159 disposed on the drive shaft 154 for converting the motion of the drive shaft 154 to the requisite motion for operating the driving fork 110 and the pump 220. Thus, as the clutch unit 159 rotates cooperatively with the drive shaft 154, it preferably slides about the drive slot 117, thereby establishing a desired up and down motion for the driving fork 110 and, ultimately, for the piston 225 of the pump 220.

As illustrated in FIG. 6, the clutch unit 159 in this preferred embodiment is a one-way clutch. In FIG. 6*a*, the clutch unit 159 includes a cam 161, a spring 162 extending outwardly from the cam 161, and a knob 160 extending outwardly from the cam 161 opposite the spring 162, whereby the cam 161, the spring 162, and the knob 160 are preferably formed as one piece. The clutch unit 159 further includes a clutch unit bore 165 extending from the spring 162 through the cam 161 for securedly receiving the drive shaft 154.

Figure 6A:
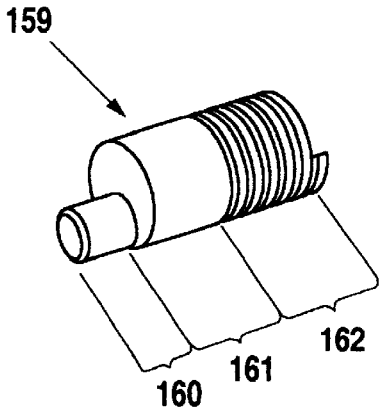
FIG. 6*a* is a perspective view of the clutch unit.
Figure 6B:
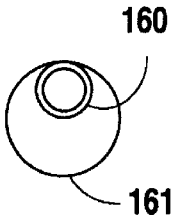
FIGS. 6*b–d* are cross-sectional views of the clutch unit.
Figure 6C:
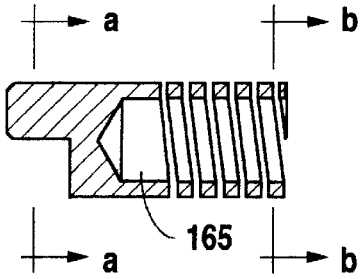
Figure 6D:
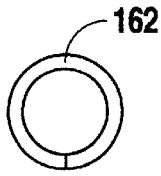

In operation, the motor 157 via the gearbox 152 propels the drive shaft 154 in the direction indicated by directional arrow 155 in FIG. 3. The drive shaft 154 in turn propels the cam 161 and the spring 162. The cam 161 and the spring 162 rotate cooperatively with the drive shaft 154, thereby allowing the knob 160 to slide about the drive slot 117 so as to ultimately drive the pump 220. In effect, the knob 160 acts as a lever and is positioned on the cam 161 so that the shape of the cam 161 provides a sufficient lever arm for the knob 160, as shown in FIG. 6*b*. Accordingly, the pump driver 100 drives the pump 220 in the following manner. The drive shaft 154 turns the clutch unit 159 disposed thereon so that the knob 160 of the clutch unit 159 engages the drive slot 117, thereby allowing for the interface 112 of the driving fork 110 to drive the pump 220.

The driver unit 150 includes the clutch unit 159 to facilitate easier engagement of the drive shaft 154 with the drive slot 117. Specifically, to link the drive shaft 154 with the drive slot 117 via the clutch unit 159, the motor 157 may be controlled to implement a reverse rotational motion, as indicated for example in FIG. 3 by directional arrow 156. When the drive shaft 154 rotates in reverse, the clutch unit 159 no longer rotates cooperatively with the drive shaft 154 but instead floats substantially freely about the turning drive shaft 154. While the clutch unit 159 floats substantially freely about the drive shaft 154, the knob 160 thus slides against the driver slot 117 with less force than required for drive shaft 154 to operatively drive the pump 220. By sliding with less force, the knob 160 moves the driving fork 110 at a rate sufficient for readily coupling with the piston 225 of the pump 220. In particular, it is relatively easy to engage the piston ears 226 of the pump 220 with the receiving slot 113 of the driving fork 110 due to the substantially free floating of the clutch unit 159. Once the driving fork 110 is connectedly engaged with the piston 225 of the pump 220, the motor 157 switches from reverse rotational motion to a rotational motion suitable for operating the pump 220.

Figure 7A:
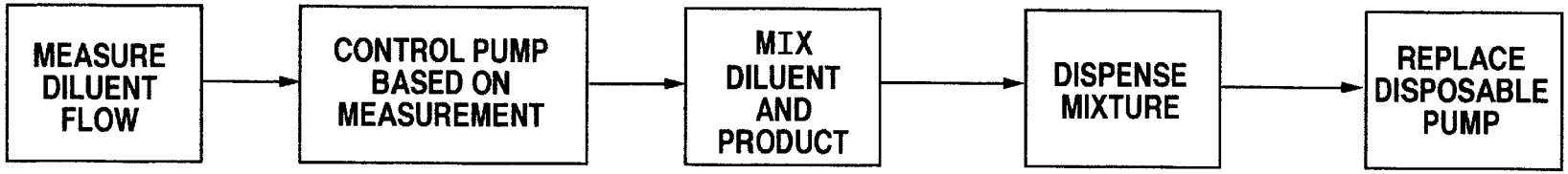
FIG. 7*a* is a flowchart of a dispense controlled according to a diluent flow rate.
Figure 7B:
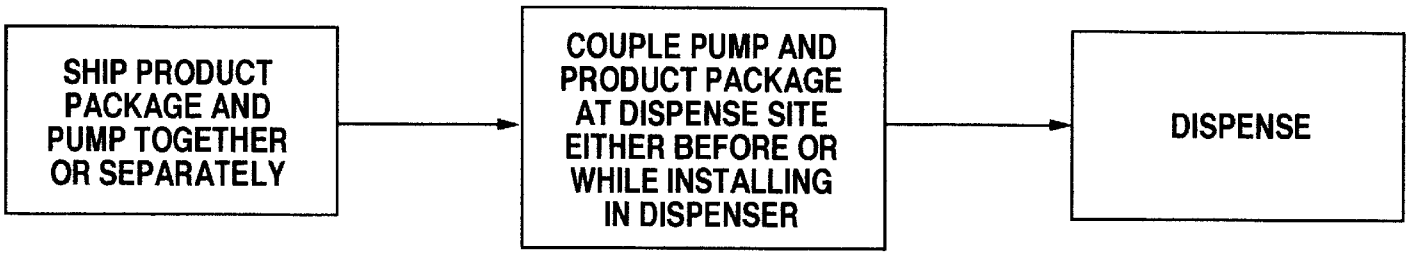
FIGS. 7*b–c* are flowcharts of a dispense preceded by the delivery and installation of a pump and a product package.
Figure 7C:
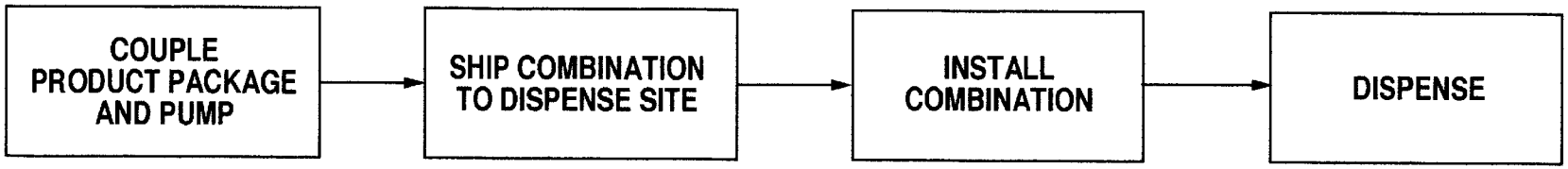

To facilitate the dispensing of product as illustrated in FIG. 7*a–c*, a product package 308 and a pump 220 are shipped either together or separately to a location containing a product dispenser 300. In some instances, the pump product package 308 and the pump 220 may be coupled together prior to shipping. The cover 302 is removed from the support housing 301, the pump 220 is inserted into the pump slot 309, and the pump 220 is connected to the pump driver 100. The mixing chamber 223, which is also typically disposable, is placed in the product dispenser 300 and connected to the dispensing outlet 224 via the tube 227. It should be understood that the mixing chamber 223 may be integral with the pump 220 or connected prior to shipping or installation. Further, the diluent inlet 228 is connected to a diluent source using any suitable means, such as tubing. The product package 308 is placed within the container 306 such that the fitting 313 resides over the pump slot 309, and the outlet 316 is snap fit into the inlet 221 of the pump 220 to facilitate the delivery of product thereto. Alternatively, the pump 220 and the product package 308 are loaded into the dispensing station 303 as an integral unit when the pump 220 and the product package 308 are coupled together either prior to shipping or prior to installation. The cover 302 is then returned onto the support housing 301 to place the product dispenser 300 in condition to dispense product.

Product dispenser 300 delivers product responsive to the activation of a user interface device, typically a switch, that connects the motor 157 to a power source, typically a regulated power supply receiving input power from a standard 115V/120V line or 230V/240V line. The user interface device may further facilitate activation of a flow control device associated with diluent delivery, typically a valve, flow controller, or suitable metering device as previously described. The activation of the motor 157 facilitates the actuation of the pump 220 via the pump driver 100 as previously described. The pump 220 draws product from the product package 308 and delivers the product from the dispensing outlet 224. A dispense associated with a metering device involves the metering device measuring the flow of diluent and outputting a signal thereof. A controller, such as a microprocessor of other known control system, drives the pump driver 100 and thus the pump 220 at a speed determined by the output signal such that the pump 220 delivers a desired amount of product for mixture with diluent. Upon the deactivation of the user interface device, the product dispenser 300 ceases the delivery of product due to the corresponding deactivation of the motor 157 and flow control device.

After the emptying of a product package 308, the cover 302 is again removed from the support housing 301, and the outlet 316 of the fitting 313 is disconnected from the inlet 221 of the pump 220. The product package 308 is then removed from within the container 306. The mixing chamber 223 is disconnected from the dispensing outlet 224, and the diluent inlet 228 is disconnected from the diluent source. The mixing chamber 223 is then removed from the product dispenser 300. Conversely, the mixing chamber could be washable in place and thus remain within the product dispenser 300. The pump 220 is disconnected from the pump driver 100 and removed from the pump slot 309. Alternatively, the pump 220 and the product package 308 are removed together as an integral unit when the pump 220 and the product package 308 are coupled together either prior to shipping or prior to installation. The product dispenser is thus ready for reloading as described above. The removed product package 308, pump 220, and mixing chamber 223 are disposed, which makes the product dispenser 300 sanitary, as the product is not exposed to the environment.

Accordingly, when a product package 308 containing concentrated product is employed, the product dispenser 300 provides a significant cost saving in terms of product shipping and storage costs. Moreover, significant quality and cost advantages are achieved because the food product is consistently dispensed, as opposed to the inconsistencies in ratio and quantity that result from manual dispensing.

Although this preferred embodiment contemplates a disposable pump, those of ordinary skill in the art will recognize that the pump 220 could be a non-disposable pump mounted within the pump slot 309 of the dispensing station 303 and utilized with multiple disposable product packages 308. In this instance, the pump 220 could be washable in place and thus remain within the dispensing station 303.

Figure 8:
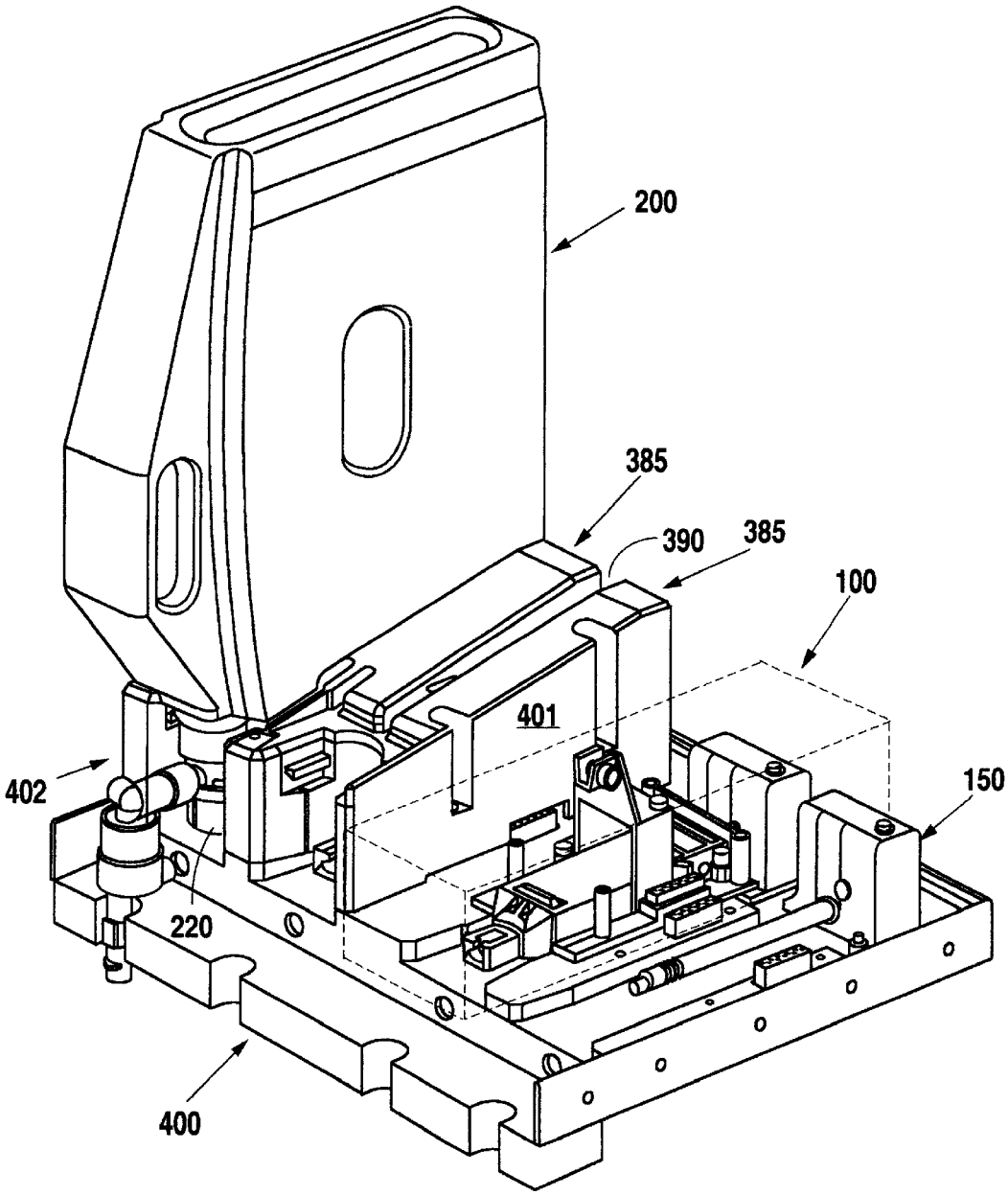
FIG. 8 is a perspective view illustrating a product dispenser according to an alternative embodiment.

As illustrated in FIG. 8, an alternative embodiment of a product dispenser 400 provides a configuration that uses a cartridge 200, which may be a permanent or disposable container, to supply product to the product dispenser 400. The product dispenser 400 is similar to the product dispenser 300 and like parts have been labeled with like numerals, except the base 401 of the dispensing station 402 includes rails 385 defining a slot 390 that receives the cartridge 200 therein. Similar to the product package 308, the cartridge 200 includes a fitting suitable for insertion into the inlet 221 of the pump 220. Consequently, after the loading of the product dispenser 400 with the cartridge 200, the product dispenser 400 operates identically to the product dispenser 300 in the dispensing of product.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

We claim:

1. A product dispenser, comprising:

a support housing;

a disposable pump;

a disposable product package connectable to the disposable pump;

a pump driver connectable to the disposable pump, the pump driver, comprising:

a driving fork, and a driver unit comprising a drive shaft and a clutch unit mountable onto the drive shaft for interfacing the drive shaft with the driving fork; and a dispensing station on the support housing, the dispensing station supporting the pump driver and adapted to receive the disposable pump and the disposable product package wherein the disposable product package and the driving fork of the pump driver connect to the disposable pump and the driver unit of the pump driver operates the driving fork to facilitate the drawing of product from the disposable product package by the disposable pump, whereby the disposable product package and the disposable pump are removed from the dispensing station and disposed when the disposable product package is empty.

2. The product dispenser according to claim 1, wherein the dispensing station, comprises:

a platform secured to the support housing;

a base residing on the platform over the pump driver, the base defining a pump slot that receives the disposable pump therein; and a container supported by the base, the container receiving the disposable product package therein.

3. The product dispenser according to claim 1, wherein the disposable product package, comprises:

a bag; and a fitting secured to the bag wherein the fitting snap fits into the disposable pump.

4. The product dispenser according to claim 3, wherein the disposable pump includes an inlet adapted to receive the fitting therein.

5. The product dispenser according to claim 1, further comprising a mixing chamber connectable to an outlet of the disposable pump, whereby the mixing chamber is disposable with the disposable pump when the disposable product package is empty.

6. The product dispenser according to claim 5, wherein the mixing chamber includes a diluent inlet that introduces diluent into the mixing chamber for combination with product delivered into the mixing chamber by the disposable pump.

7. The product dispenser according to claim 5, further comprising a product delivery device coupled to an outlet of the mixing chamber.

8. The product dispenser according to claim 1, further comprising a dispensing outlet coupled to an outlet of the disposable pump.

9. The product dispenser according to claim 1, further comprising a cover mounted over the support housing.

10. The product dispenser according to claim 1, wherein the driving fork includes an interface that engages a piston of the disposable pump to couple the driving fork with the disposable pump.

11. The product dispenser according to claim 1, wherein the pump driver further comprises a frame mountable to the dispensing station and adapted to link the driving fork with the driver unit.

12. The product dispenser according to claim 1, wherein the driver unit further comprises a motor.

13. The product dispenser according to claim 12, wherein the driver unit further comprises a gearbox coupled with the drive shaft and with the motor for transferring the driving force of the motor to the drive shaft.

14.The product dispenser according to claim 13, wherein the driving fork includes a drive slot that engages the drive shaft of the driver unit to couple the driving fork with the driver unit.

* * * * *